US006485269B1

(12) United States Patent
Matthew et al.

(10) Patent No.: US 6,485,269 B1
(45) Date of Patent: Nov. 26, 2002

(54) DETACHABLE AIR COMPRESSOR UNIT AND SYSTEM

(75) Inventors: Mark R. Matthew, New Ulm, MN (US); David McCoy, Oswego, IL (US); Tom Graber, New Ulm, MN (US); Richard Hawkes, Naperville, IL (US); Keith Kristiansen, Statford, CT (US); John Kiely, Morris Plains, NJ (US); Gary Grossman, Riverside, CT (US); Thomas C Vandyk, Ramsey, NJ (US); Kurt Beckman, New Ulm, MN (US)

(73) Assignee: Coleman Powermate, Inc., Kearney, NE (US)

( * ) Notice: Subject to any disclaimer, the term of this patent is extended or adjusted under 35 U.S.C. 154(b) by 0 days.

(21) Appl. No.: 09/614,952

(22) Filed: Jul. 12, 2000

(51) Int. Cl.[7] ..... F04B 39/12
(52) U.S. Cl. ..... 417/234; 417/360
(58) Field of Search ..... 417/234, 238, 417/360, 410.1

(56) References Cited

U.S. PATENT DOCUMENTS 1,718,178 A * 6/1929 Oliphant ..... 417/234
1,756,806 A * 4/1930 Beach ..... 417/234
1,771,889 A * 7/1930 Hobart ..... 417/234
2,789,756 A * 4/1957 Allen ..... 417/234
2,804,259 A * 8/1957 Ralston ..... 417/234
2,812,895 A * 11/1957 Peeps ..... 417/234
4,722,673 A * 2/1988 Grime et al. ..... 417/360
4,768,930 A 9/1988 Grime et al.

* cited by examiner

*Primary Examiner*—Michael Koczo
(74) *Attorney, Agent, or Firm*—Kramer, Levin, Naftalis & Frankel, LLP

(57) ABSTRACT

A detachable air compressor system includes a detachable air compressor unit and a second storage tank. The detachable air compressor unit is portable and includes an air pump powered by a motor and connected to a first storage tank, where the pump, motor, and first storage tank are all connected to a first base. The first storage tank is also attached to a regulator in order to release the compressed air stored inside and to a first coupler to permit the transport of compressed air between the first storage tank and the second storage tank. The detachable air compressor unit can be attached to a second storage tank of a larger size than the first storage tank. The second storage tank includes a second coupler adapted for receiving the first coupler from the first base as well as a second base adapted for coupling with the first base to removably secure the detachable air compressor unit to the second storage tank.

14 Claims, 4 Drawing Sheets

DETACHABLE AIR COMPRESSOR UNIT AND SYSTEM

FIELD OF THE INVENTION

This invention relates to detachable air compressor units and detachable air compressor systems.

BACKGROUND INFORMATION

Air compressor units are well known and have a wide variety of uses. For example, air compressors can be used to power air tools, inflate tires, blow leaves, etc.

Currently, air compressor units comprise an air pump connected to a storage tank. Air is drawn by the air pump into a chamber where it is compressed and then transferred into the storage tank where it remains until it is needed.

Existing air compressor units only have one storage tank, and thus, the portability of the air compressor often depends on the size of the storage tank. In other words, if the storage tank is a large one, then the air compressor unit would not be very portable since it would be cumbersome to move the air compressor unit from location to location due to the weight and size of the storage tank. Thus, air compressor units with large storage tanks are not useful when the unit needs to be moved frequently among various locations.

On the other hand, if the storage tank is a small one, then the air compressor unit would be portable and the user can carry the unit anywhere since the weight of the storage tank would not be too heavy. However, the amount of compressed air stored for use is dependent on the size of the storage tank. Thus, air compressor units with small storage tanks also have limited use since they cannot hold enough compressed air to, for example, power an air tool for an extended period of time.

SUMMARY OF THE INVENTION

In an exemplary embodiment, the present invention allows a user to enjoy both the portability benefits of small storage tanks and the duration benefits of large storage tanks by providing for a detachable air compressor unit and system. In the detachable air compressor system of the present invention, there is provided a detachable air compressor unit which is removably attached to a second storage tank.

In the detachable air compressor unit of the present invention, there is provided an air pump powered by a motor and connected to a first storage tank, where the pump, motor, and first storage tank are all connected to a first base. The first storage tank is also attached to a regulator in order to release the compressed air stored inside and to a first coupler to permit the transport of compressed air between the first storage tank and the second storage tank.

In an exemplary embodiment, a second storage tank of the detachable air compressor system is of a larger size than the first storage tank of the detachable air compressor unit. The second storage tank includes a second coupler and second base respectively adapted for receiving the first coupler and first base from the detachable air compressor unit.

DETAILED DESCRIPTION OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details. Furthermore, well known features may be omitted or simplified in order not to obscure the present invention.

In the exemplary embodiment, there is provided a detachable air compressor unit and system. In the exemplary embodiment shown in FIG. 2, the detachable air compressor system includes a detachable air compressor unit 1 which is removably attached to a second storage tank 10.

Figure 1:
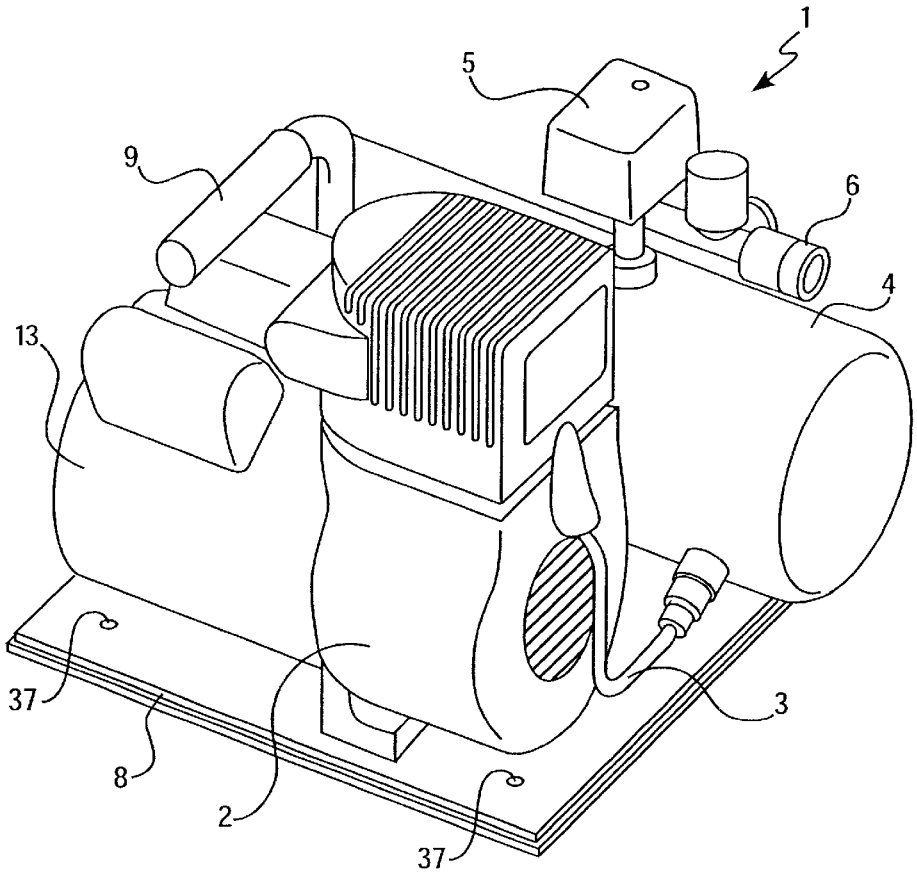
FIG. 1 is a perspective view of an exemplary embodiment of a detachable air compressor unit in accordance with the present invention.

As shown in FIG. 1, the detachable air compressor unit 1 in the exemplary embodiment includes an air pump 2 connected by tube 3 to a first storage tank 4. In the exemplary embodiment, the air pump 2 is powered by a motor 13. The air pump 2, motor 13, and first storage tank 4 are all affixed, either removably or permanently, to a first base 8. When activated, the air pump 2 draws air into a chamber (not shown) where the air is compressed and then released into the first storage tank 4. The air pump 2, motor 13, and first storage tank 4 may be any air pump, motor or engine, and storage tank designs known in the art.

As shown in the exemplary embodiment in FIG. 1, the first storage tank 4 includes, for example, a regulator 5 and an outlet 6 to allow the compressed air stored inside tank 4 to be released, for example, for use with an air tool (not shown). The regulator 5 also is used to control the amount of air pressure which will be released. In the exemplary embodiment, the first storage tank 4 also is connected by a tube 6 to a first coupler 7 which is attached to the first base 8 as shown in FIGS. 2 and 3.

Figure 2:
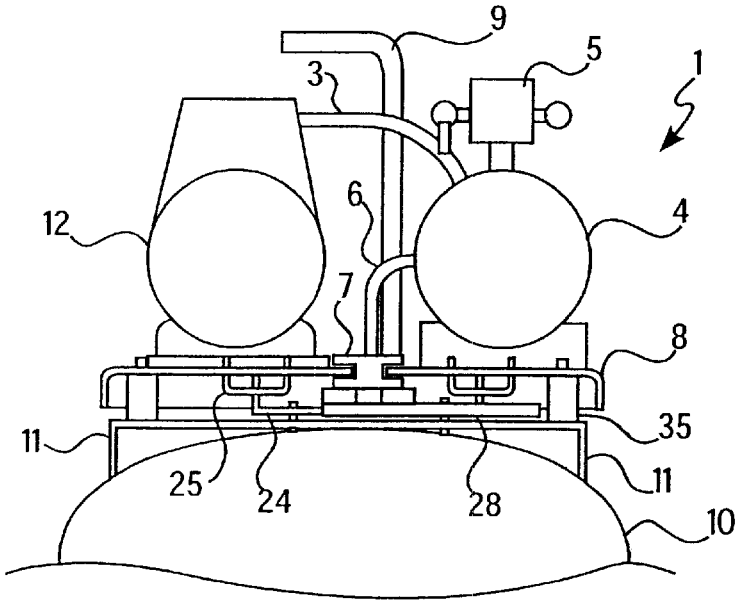
FIG. 2 is a partial front view of an exemplary embodiment of a detachable air compressor system in accordance with the present invention where the detachable air compressor unit is attached to the second storage tank.
Figure 3:
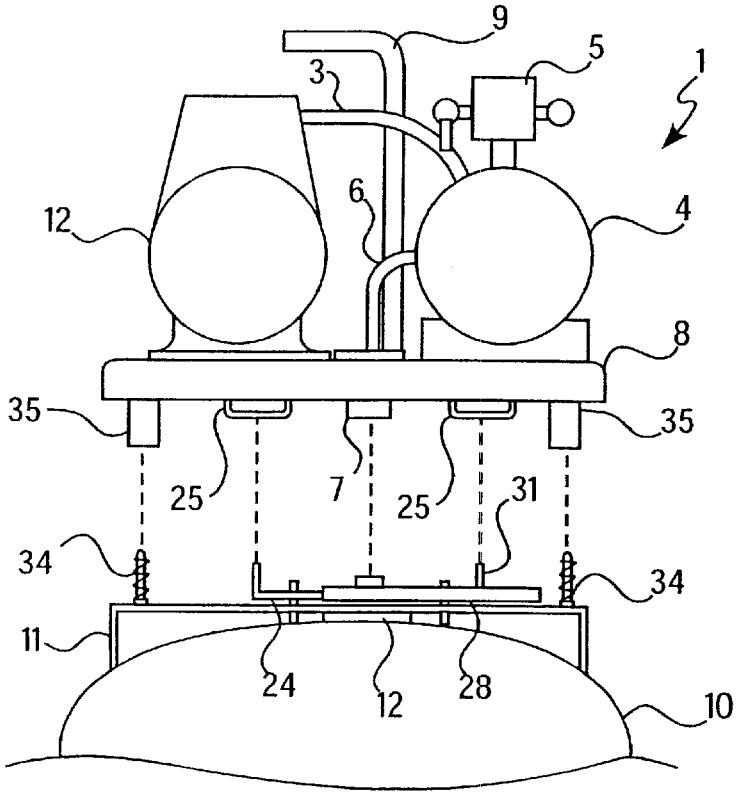
FIG. 3 is a partial front view of an exemplary embodiment of a detachable air compressor system in accordance with the present invention where the detachable air compressor unit is not attached to a second storage tank.

There is also a handle 9 as shown in FIGS. 1–3 attached to the first base 8 for carrying around the detachable air compressor unit 1. Thus, it is preferred that the air pump 2, motor 13 and first storage tank 4 be of such size and weight that the user may be able to comfortably carry the detachable air compressor unit 1.

For uses that require more compressed air than the first storage tank 4 can hold, there is provided as part of the detachable air compressor system in the exemplary embodiment a second storage tank 10 for the detachable air compressor unit 1 to attach to. As shown in FIG. 3, the second storage tank 10 also includes a second base 11 and a second coupler 12. The second base 11 and second coupler 12 may be welded onto the second storage tank 10 or attached by any means known in the art including a removable connection. The second storage tank 10 may be of any design known in the art and preferably has a larger storage capacity than first storage tank 4.

Figure 7:
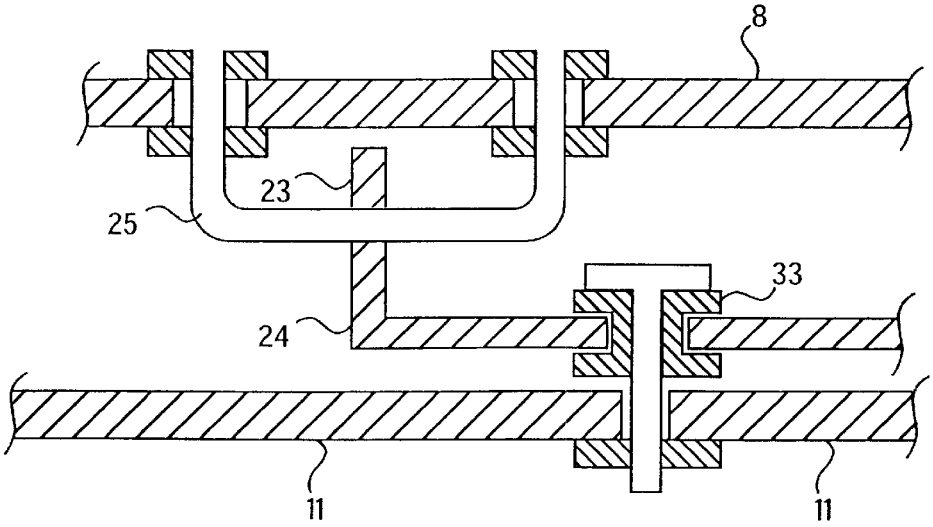
FIG. 7 is a close up front view of an exemplary embodiment of the detachable air compressor system illustrating the mechanism for removably securing the first base to the second base of the present invention.
Figure 8:
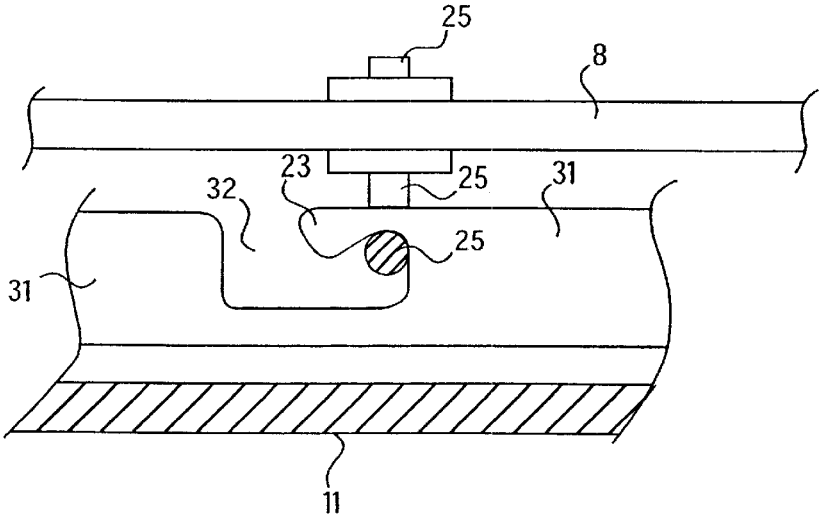
FIG. 8 is a cut away side view of an exemplary embodiment of the detachable air compressor system illustrating the mechanism for removably securing the first base to the second base of the present invention.

In order to secure the detachable air compressor unit 1 to the second storage tank 10, in the exemplary embodiment shown in FIGS. 7 and 8, U-bolts 25 attached to or extending through the first base 8 of the detachable air compressor unit 1 are each held in place, for example, by a plurality of latching fingers 23 on tray 24 affixed to second base 11.

In the exemplary embodiment shown in FIGS. 7 and 8, the U-bolts 25 may be attached to first base 8, for example, by a nut and bolt assembly. Other means of attaching the U-bolt 25 may be used such as welding or threaded screws. Additionally, the U-bolts 25 may take on any shape so long as it can be held down by latching fingers 23. Any other means known in the art for securing one component to another may also be used.

Figure 4:
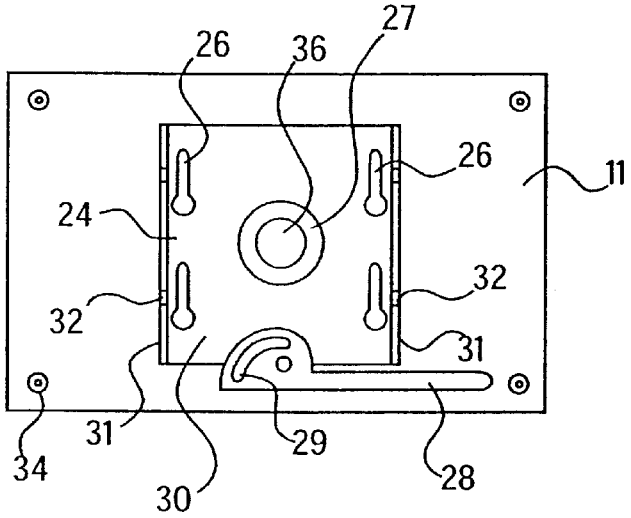
FIG. 4 is a top plan view of an exemplary embodiment of the second base of the detachable air compressor system in accordance with the present invention.
Figure 5:
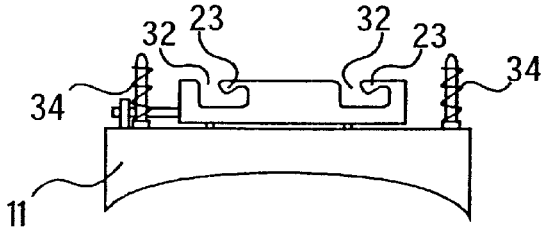
FIG. 5 is a side view of an exemplary embodiment of the second base of the detachable air compressor system in accordance with the present invention.

In the exemplary embodiment shown in FIGS. 4 and 5, tray 24 includes a horizontal plate 30 and two vertical walls 31 at each end. The vertical walls 31 each have latching fingers 23 which hold down the U-bolts 25 of the first base 8 as shown in FIGS. 7 and 8. For example, two latching fingers 23 are shown in a vertical wall 31 in FIG. 5. Tray 24 is attached to the second base 11 by means of, for example, a nut and bolt assembly at various keyhole slots 26 on the tray 24. A plastic bushing 33 as shown in FIG. 7 also may be inserted at the keyhole slots 26 to help stabilize this assembly.

As shown in the exemplary embodiment in FIG. 4, a latch handle 28 with a pathway 29 is also attached to the tray 24 and second base 11 such that the rotation of the latch handle 28 in one direction will pull the tray 24 toward the latch handle 28 so that the U-bolts 25 will slip into the latching fingers 23 (as seen in FIGS. 7 and 8), thereby securing the first base 8 to the second base 11. Conversely, the rotation of the latch handle 28 in the other direction will push the tray 24 away from the latch handle 28 so that the U-bolts 25 will slip through the openings 32 in the vertical walls 31 to release the detachable air compressor unit 1 from the second base 11.

Tray 24 also contains, for example, a hole 27 as shown in FIG. 4 for the first coupler 7 to penetrate. To allow for movement of tray 24 by the latch handle 28, this hole 27 will be larger in diameter than the first coupler 7 or hole 36 in second base 11.

To help align the first base 8 with the second base 11, the second base 11 also may include alignment posts 34 as shown in FIGS. 3–5 which fit into the alignment holes 37 shown in FIG. 1. There may be springs on the alignment posts 34 as well as rubber footings 35 on the first base 8 to help stabilize the assembly when in use.

In the exemplary embodiment shown in FIGS. 2 and 3, the second base 11 and second coupler 12 are both located on the top of second storage tank 10. One skilled in the art will recognize that the second base 11 and second coupler 12 can be located in other areas of the second storage tank 10 depending on the orientation, size, and shape of the second storage tank 10.

Thus, when the detachable air compressor unit 1 is properly secured to the second base 11 as shown in FIG. 2, the first coupler 7 of the detachable air compressor unit 1 is inserted into the second coupler 12 of the second storage tank 10 so that the compressed air may travel from first storage tank 4 through tube 6, through first coupler 7, through second coupler 12 and into the second storage tank 10 until the second storage tank 10 is filled to capacity, the air pump 2 is turned off, or an equilibrium pressure is established.

Figure 6:
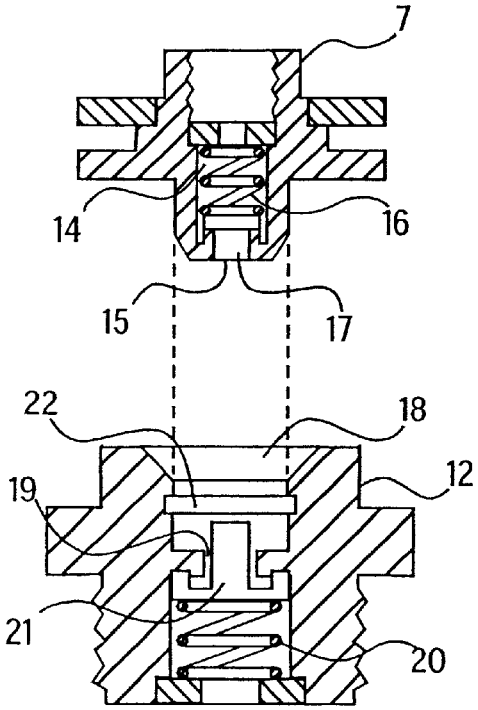
FIG. 6 is a cut away front view of an exemplary embodiment of the first and second couplers of the detachable air compressor system in accordance with the present invention.

As shown in an exemplary embodiment in FIG. 6, the first coupler 7 includes a pathway 14 leading to an bottom opening 15 which is sealed by a top plunger 17 being pushed by spring 16 into the bottom opening 15. Conversely, the second coupler 12 includes a receptacle 18 for receiving the first coupler 7, and a top opening 19 which is sealed by a bottom plunger 21 being pushed by spring 20 into the top opening 19. There also can be an O-ring 22 which operates to, for example, prevent any air from leaking or escaping out of the second storage tank 11 through second coupler 12. In the exemplary embodiment shown in FIG. 6, the bottom plunger 21 extends beyond the top opening 19 so that when the first coupler 7 is inserted into the receptacle 18 of the second coupler 12 and through the O-ring 22, the top plunger 17 of the first coupler 7 will abut the bottom plunger 21 of the second coupler 12 and the two plungers will each push the other in the opposite direction so that the openings 15 and 19 will become unsealed and compressed air can flow freely between the two storage tanks 4 and 10. Any other coupler or valve design known in the art which allow air to travel between two containers also may be used.

Since the connection of the first coupler 7 with the second coupler 12 creates a path for the compressed air to freely travel between the first storage tank 4 and second storage tank 10, compressed air stored in the second storage tank 10 may be released using the same regulator 5 on the first storage tank 4 as shown in the FIGS. 1–3. When the detachable air compressor unit 1 is attached to the larger second storage tank 10, there is much more compressed air that can be used and thus, the duration of use is much longer (e.g., 30 minutes versus 5 minutes).

In an alternative embodiment, there may be a second regulator (not shown) and second outlet (not shown) located on the second storage tank 10 itself so that compressed air may be released from the second storage tank 10 without using the detachable air compressor unit 1.

Thus, in the exemplary embodiment of the present invention, a user can choose to use a detachable air compressor unit 1 alone when small durations or quantities of compressed air is needed. Or, if long durations or large quantities of compressed air are needed, the user can take advantage of the larger capacity of the second storage tank 10 by attaching the detachable air compressor unit 1 to the second storage tank 10 by aligning the first base 8 with the alignment posts 34 of the second base 11 and then rotating the latch handle 28 in the proper direction to cause the latching fingers 23 to hold down U-bolts 25 of first base 8 to ensure a tight fit of first coupler 7 into second coupler 12 so that the compressed air may freely travel between the two storage tanks 4 and 10.

What is claimed is:

1. A detachable air compressor unit comprising:

an air pump for compressing air;

a motor actuating the air pump;

a first storage tank connected to the air pump for receiving and storing compressed air from the air pump;

a regulator attached to the first storage tank for controlling a release of compressed air from the first storage tank;

a handle;

a first base supporting the air pump, the motor, the first storage tank and the handle; and a first coupler connected to the first storage tank and the first base, wherein the first coupler is adapted for releasable coupling with a second coupler located on a second storage tank to provide a path for compressed air to travel between the first storage tank and the second storage tank.

2. The detachable air compressor unit of claim 1 wherein the first base includes a plurality of U-bolts that releasably engage a respective one of a plurality of latching fingers on a second base connected to the second storage tank.

3. The detachable air compressor unit of claim 2 wherein the first base includes a plurality of alignment holes and rubber footings adapted for receiving a respective one of a plurality of alignment posts of the second base.

4. The detachable air compressor system of claim 1 wherein the detachable air compressor unit includes:

an air pump for compressing air, said air pump connected to the first storage tank so that the first storage tank may receive and store compressed air;

a motor actuating the air pump;

a regulator attached to the first storage tank for controlling a release of compressed air from the first storage tank; and a handle, wherein the air pump, the motor, the first storage tank and the handle are supported by the first base.

5. The detachable air compressor system of claim 4 wherein compressed air stored in the second storage tank may be released using the regulator attached to the first storage tank when the detachable air compressor unit is attached to the second storage tank.

6. The detachable air compressor system of claim 4 wherein compressed air stored in the second storage tank may be released using a second regulator attached to the second storage tank.

7. The detachable air compressor system of claim 4 wherein the second base includes:

a tray having a horizontal plate with a hole and at least one slot and at least one vertical wall having at least one latching finger, and a latch handle attached to the tray such that the rotation of the latch handle in one direction pulls the tray toward the latch handle and the rotation of the latch handle in an opposite direction pushes the tray away from the latch handle.

8. The detachable air compressor system of claim 7 wherein the second base includes a plurality of alignment posts.

9. The detachable air compressor system of claim 7 wherein the first base of the detachable air compressor unit includes a plurality of U-bolts that releasably engage a respective one of the at least one latching finger.

10. The detachable air compressor system of claim 8 wherein the first base of the detachable air compressor unit includes a plurality of alignment holes and rubber footings adapted for receiving a respective one of the plurality of alignment posts from the second base of the second storage tank.

11. The detachable air compressor system of claim 7 wherein the first coupler includes a pathway and a first opening, the first opening in the first coupler being sealed by a first plunger and spring assembly; and the second coupler includes a receptacle for receiving the first coupler, an O-ring to prevent compressed air from freely leaving or entering the second storage tank when the first coupler is not engaged with the second coupler, and a second opening, the second opening being sealed by a second plunger and spring assembly;

wherein the engagement of the first coupler with the second coupler causes the first and second openings to become unsealed so that air may flow in either direction between the first coupler to the second coupler.

12. The detachable air compressor system of claim 9 wherein the securing of the detachable air compressor unit to the second storage tank is actuated by the rotation of the latch handle in a first direction which pulls the tray toward the latch handle so that the at least one latching finger on the tray of the second base will engage and hold down a respective one of the plurality of U-bolts on the first base of the detachable air compressor unit.

13. The detachable air compressor system of claim 12 wherein the release of the detachable air compressor unit from the second storage tank is actuated by the rotation of the latch handle in a second direction which pushes the tray away from the latch handle so that the at least one latching finger on the tray of the second base will disengage the respective one of the plurality of U-bolts on the first base of the detachable air compressor unit.

14. The detachable air compressor system of claim 11 wherein the engagement of the first coupler with the second coupler occurs when the detachable air compressor unit is secured to the second storage tank.

* * * * *